United States Patent [19]

Kotthuas

[11] 4,265,053

[45] May 5, 1981

[54] APPARATUS FOR GRINDING CUTTING TOOLS

[75] Inventor: Erich Kotthuas, Wallisellen, Switzerland

[73] Assignee: Werkzeugmaschinenfabrik Oerlikon-Bührle AG, Zürich, Switzerland

[21] Appl. No.: 964,084

[22] Filed: Nov. 27, 1978

Related U.S. Application Data

[62] Division of Ser. No. 874,463, Feb. 2, 1978, Pat. No. 4,183,182.

[51] Int. Cl.[3] ..... B24B 3/02

[52] U.S. Cl. ..... 51/3; 51/166 T

[58] Field of Search ..... 51/166 T, 3, 98.5, 288, 51/326

[56] References Cited

U.S. PATENT DOCUMENTS

| | | | |
|---|---|---|---|
| 1,285,124 | 11/1918 | Gleason | 51/3 |
| 1,855,662 | 4/1932 | Bayley | 51/166 T |
| 2,332,421 | 10/1943 | Wildhaber | 51/288 X |
| 2,410,348 | 10/1946 | Johanson | 51/288 X |
| 2,423,367 | 7/1947 | Bolender | 51/166 T X |
| 2,629,973 | 3/1953 | Candee | 51/288 X |
| 2,911,767 | 11/1959 | Sielemann | 51/166 T |
| 2,976,737 | 3/1961 | Evans | 51/166 T |
| 3,498,002 | 3/1970 | Lapointe | 51/3 |

*Primary Examiner*—Gary L. Smith

*Attorney, Agent, or Firm*—Werner W. Kleeman

[57] ABSTRACT

An apparatus for grinding cutting tools attached to a cutter head for gear cutting machines, the cutter head having sets of cutting tools encompassing three respective groups of cutting tools, specifically inner cutters, outer cutters and auxiliary cutters. Two groups of the cutting tools are removed from the cutter head, the first group of cutting tools is completely ground at the cutter head, the second group of cutting tools is inserted into the cutter head and completely ground, and then the third group of cutting tools is inserted in the cutter head and completely ground.

1 Claim, 4 Drawing Figures

FIG. 2
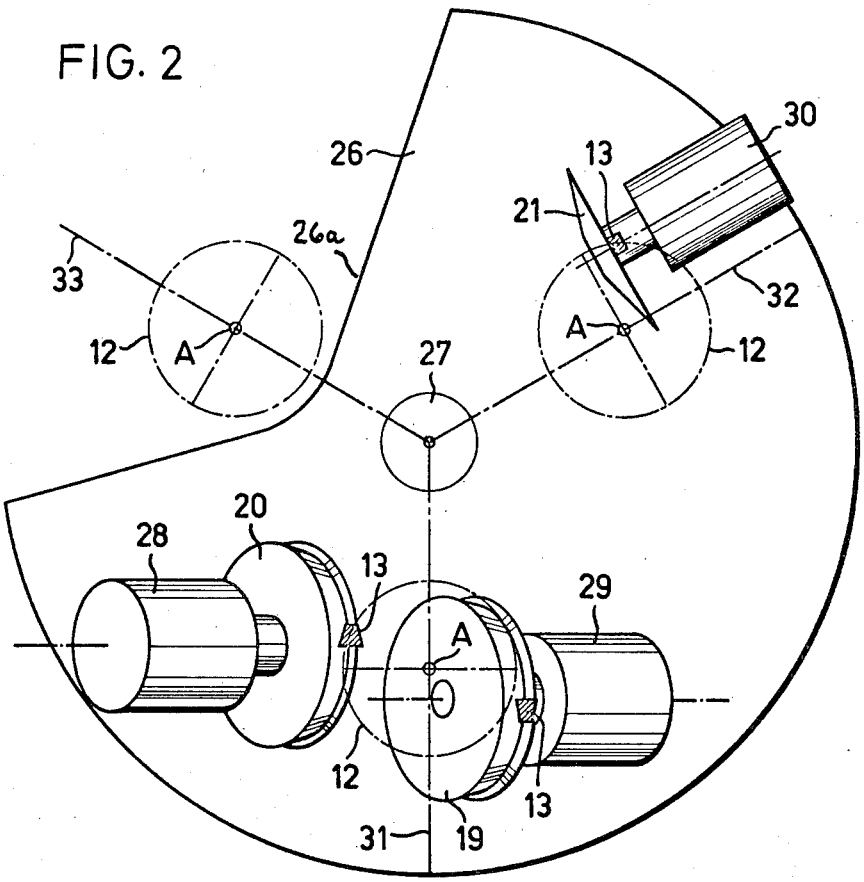
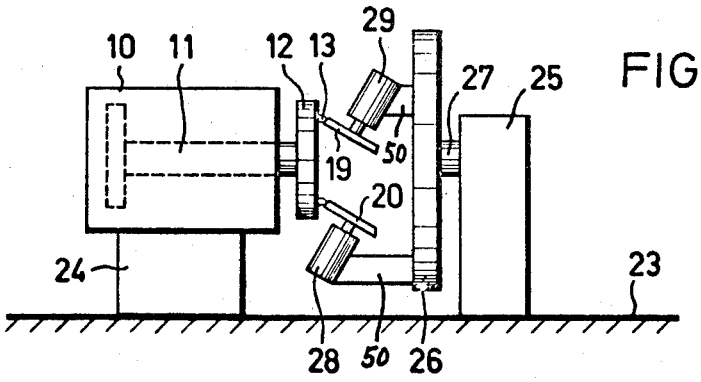
FIG. 4

APPARATUS FOR GRINDING CUTTING TOOLS

CROSS-REFERENCE TO RELATED CASE

This is a divisional application of my copending, United States application Ser. No. 874,463, filed Feb. 2, 1978, now U.S. Pat. No. 4,183,182, issued Jan. 15, 1980.

BACKGROUND OF THE INVENTION

The present invention relates to a new and improved apparatus for grinding cutters or cutting tools which are attached to a cutter head for gear cutting machines, the cutter head having sets of cutters or cutting tools encompassing three respective groups of cutting tools, namely inner cutters, outer cutters and auxiliary cutters.

According to a state-of-the-art method of this type as disclosed in Swiss Pat. No. 450,949 and the corresponding U.S. Pat. No. 3,487,592, it is necessary to remove all of the cutters or cutting tools from the cutter head, to attach them to a longitudinal slide of a grinding machine, grind the cutters, and then to again exactly insert them in the cutter head. So that the cutters of the cutter head can be exactly identically ground, it is necessary for the purpose of achieving the desired accuracy, to simultaneously secure an entire group of cutters or cutting tools at the longitudinal slide of the grinding machine. When working with large cutter heads equipped with a great many cutting tools or cutters it is therefore necessary to use extremely long slides, which, in turn, impairs the grinding accuracy and increases the grinding time.

SUMMARY OF THE INVENTION

Hence, it is a primary object of the present invention to provide an improved apparatus for grinding cutters in a manner not associated with the aforementioned drawbacks and limitations of the prior art proposals.

Another and specific object of this invention relates to an improved apparatus for grinding cutters in a manner affording extreme accuracy in the grinding operation and reduced grinding time.

Still a further significant object of the present invention relates to a novel apparatus for grinding cutters or cutting tools attached to a cutter head of gear cutting machines, wherein the cutters can be successively reground in groups at the cutter head.

Yet a further significant object of the present invention aims at the provision of a new and improved construction of apparatus for grinding cutting tools, which apparatus is relatively simple in construction and design, easy to use, extremely reliable in operation and affords accurate grinding of the cutting tools and reduced grinding times.

Now in order to implement these and still further objects of the invention, which will become more readily apparent as the description proceeds, the method aspects of the present development are manifested by the features that two groups of cutters or cutting tools are removed from the cutter head, the first cutter group is completely ground at the cutter head, the second cutter group is inserted into the cutter head and completely ground and then the third cutter group is inserted into the cutter head and completely ground.

The invention is not only concerned with the aforementioned method aspects but as already alluded to above, relates to improved apparatus in the form of a grinding machine for the performance of the aforesaid method. According to the apparatus aspects of the invention the grinding machine is manifested by the provision of a clamping or chucking device for the cutter head containing a plurality of cutters or cutting tools. A first grinding disc grinds the outer flanks of such cutters, a second grinding disc grinds the inner flanks of the cutters, a third grinding disc grinds the cutting or chip surfaces of these cutters. There is also provided a respective separate drive for each of the three mentioned grinding discs. Additionally, a disc member or disc is provided, at which there are attached the grinding discs with their drives in order to selectively bring into engagement at least one of the grinding discs with the cutters arranged at the cutter head.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 2 schematically illustrates in front view the grinding machine of the invention;

FIG. 4 schematically illustrates in side view the grinding machine of the invention;

DETAILED DESCRIPTION OF THE PREFERRED EMBODIMENTS

Figure 1:
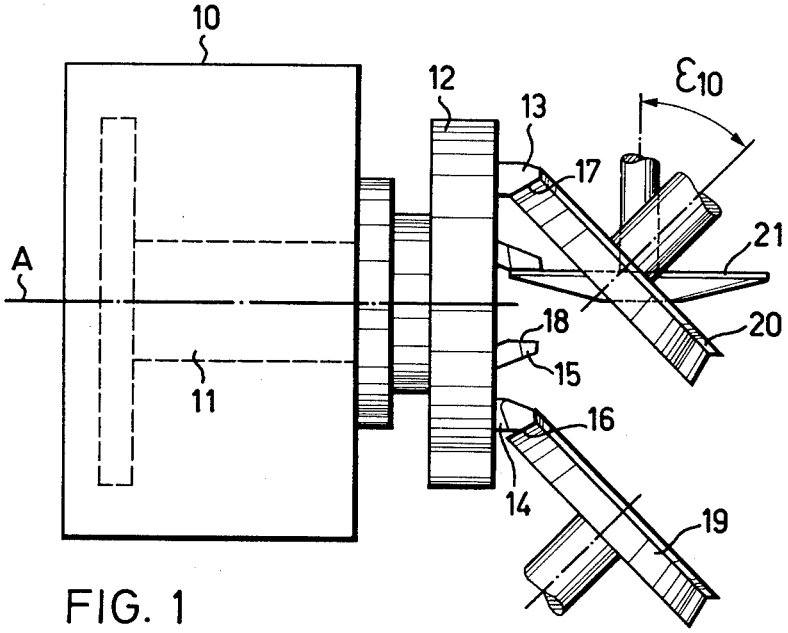
FIG. 1 illustrates in side view a cutter head and three grinding discs of a grinding machine for practising the method aspects of the invention.

During the fabrication of gears at gear cutters or cutting machines of the type having a cutter head equipped with a number of cutters or cutting tools for cutting the tooth gaps out of a workpiece, it was heretofore conventional practice to remove the cutter head together with the dull cutters out of the gear cutting machine and all of the cutters out of the cutter head. The cutters or cutting tools are then reground at a special grinding machine. Each type of cutter, classified into pre-cutters, outer cutters and inner cutters, was divided into groups, and secured in groups to the carriage of a grinding machine and ground. The requisite setting was computed electronically. During one chucking or clamping operation it was possible after carrying out a first basic setting to grind the flank surfaces or faces and the top surfaces or faces of one side of the cutters and, thereafter, following a second basic setting, to grind the flank surfaces and top surfaces of the other side of the cutters. Then the cutters had to be released and thereafter after turning them through 90° again inserted into the grinding machine. Following a third basic setting it was possible to grind the cutting faces or surfaces of the cutting tools. After these operations the group of cutters was completely ground and could again be inserted into the cutter head.

These procedures were not associated with any particular difficulties as long as the number of cutters provided at the cutter head was not too great. When 13 cutters of a group were present it was necessary that there be available for instance a carriage stroke at the grinding machine amounting to 700 mm, in order to accommodate 13 clamping locations, notwithstanding the most compact construction. Clamping or chucking of the entire cutter groups was necessary for the cutters of a cutter head, since in this way there was present the smallest errors of the cutters relative to one another. The thus ground cutters were clamped into accurate slots of the cutter head at a predetermined height. What is then decisive for the accuracy of the cutter position in the cutter head are the deviations at the clamping locations in the grinding machine and the deviations at the cutter shafts or shanks and the cutting tool-receiving slots of the cutter head. All of these parts must be extremely accurate, so that the position of the cutters relative to one another do not possess any too large deviations.

These observations as concerns the prior art grinding techniques have shown that it is necessary to devise a new method whenever the number of cutters of a group becomes still larger, if extremely high requirements are placed upon accuracy, and if the cutters are to be ground in a brief amount of time.

Now for a new grinding method there are to be taken into account the following points:

(1) The cutter profiles must only be accurately ground at the region of the cutting edges.
(2) The profile or shape of the grinding discs must contain the flank shape, head radius and head surface.
(3) The left and right cutter flanks must be able to be separately ground in two working operations, in order to be able to randomly affect the cutter front clearance angle.
(4) It must be possible to grind cutting face angles up to 20°.
(5) It must be possible to grind cutter groups containing as many as up to 23 cutters or cutting tools.
(6) It must be possible to grind cutter heads having a radius of 210 mm.
(7) Grinding costs must be lower than heretofore.
(8) The grinding machine must be more compact than heretofore.
(9) The ground cutters should be capable of being more accurately aligned at the cutter head.

Referring now to the drawings, according to the showing of FIG. 1 a shaft 11 is rotatably mounted in a housing 10. Exchangeably attached in any convenient fashion to this shaft 11 is a cutter head 12. This cutter head 12 possesses a number of cutters 13, 14 and 15. As best seen by referring to FIG. 3, each three respective cutters 13, 14 and 15 form a cutter set. One such cutter set comprises an outer cutter 13, an inner cutter 14 and an auxiliary cutter 15. The spacing of such three cutters or cutting tools 13, 14 and 15 from the lengthwise axis A of the cutter head 12 varies. All of the outer cutters 13 are located along a first circle having the radius $r_1$, all of the inner cutters 14 are located along a second circle having the radius $r_2$, and all of the auxiliary cutters 15 are located at a third circle having a radius $r_3$. The sequence of such cutters 13, 14 and 15 within a cutter set can be different. Thus, for instance, the auxiliary cutters 15 can be located at a location between the outer cutters 13 and the inner cutters 14 at the circle having the radius $r_2$, but this possibility has not been particularly illustrated in the drawings since it will be evident from what has been explained and illustrated.

Figure 3:
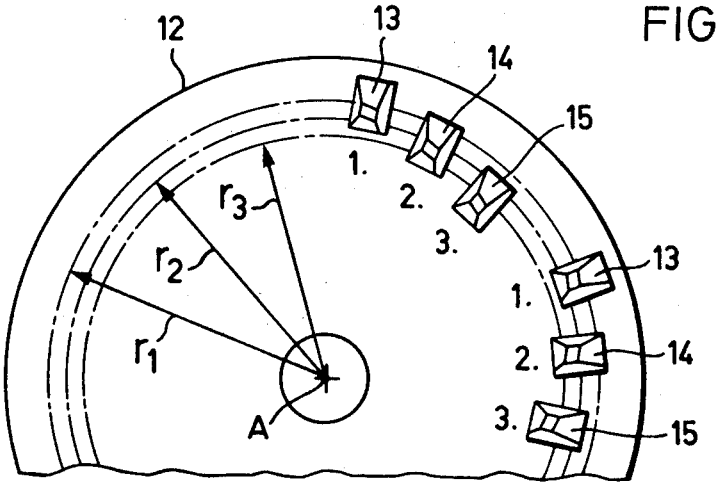
FIG. 3 illustrates in front view a cutter head as shown in the arrangement of FIG. 1.

According to the showing of FIG. 3, the grinding of the first cutter 13 of a set is hindered by the second cutter 14 of the same set, and equally, the grinding of the second cutter 14 of a set is hindered by the third cutter 15 of such set. The grinding of the third cutter 15 however is not hindered in any manner. Therefore it is necessry in order to grind the first cutter 13 of a set to remove the second cutter 14 of such set and for grinding the second cutter 14 of a set it is necessary to remove the third cutter 15 of such set.

Each cutter possesses an outer flank or face 16, an inner flank or face 17 and a cutting face or surface 18. According to the showing of FIG. 1, there is required for grinding the outer flank 16 a first grinding disc 19, for grinding the inner flank 17 a second grinding disc 20, and for grinding the cutting face of surface 18 a third grinding disc 21. The axes of the first and second grinding discs 19 and 20 are inclined by the angle $E_{10}$ with regard to the cutter head axis A. The axis of the third grinding disc 21 is at right angles to the cutter head axis A.

The construction of the grinding machine will be best apparent by referring to FIGS. 2 and 4. According to the showing of FIG. 4 a support or carrier 24 is attached to a not further illustrated machine bed 23. Upon the carrier or support 24 there is arranged the housing 10 with the shaft 11 and the cutter head 12. Further, a second support or carrier 25 is attached to the machine bed 23, upon which there is rotatably mounted a disc or disc member 26 about a horizontally arranged shaft 27. Attached to this disc 26 are three drive motors 28, 29 and 30. These motors 28, 29 and 30 can be displaced in any convenient fashion, for instance by the schematically indicated adjustment means 50 (FIG. 4), both in radial as well as in tangential direction upon the disc 26, so that they can be set in accordance with the size of the cutter head 12 and the momentary position of the cutters in such cutter head 12. Attached to the not particularly referenced drive journals of these three motors 28, 29 and 30 are the aforementioned three grinding discs 19, 20 and 21 respectively. The first motor 29 carries the first grinding disc 19 for the outer flank 16. The second motor 28 carries the second grinding disc 20 for the inner flank 17. Finally, the third motor 30 carries the third grinding disc 21 for the cutting face or surface 18.

As best seen by referring to FIG. 2, the cutter head axis A, during grinding of the outer and inner flanks 16 and 17 of the cutter 13, intersects a first radius 31 of the disc 26 and the motor axes of the motors 28 and 29 may be disposed at right angles to this first radius 31. During grinding the cutting surface or face 18 of the cutter 13 the cutter head axis A intersects a second radius 32 of disc 26 and the motor axis of the motor 30 is disposed parallel to such second radius 32. If the cutters 13, 14 and 15 are not ground, then the cutter head axis A intersects a third radius 33 of the disc 26. At this position the cutter head can be exchanged.

The mode of operation of the aforedescribed grinding machine will now be considered and is as follows:

According to the showing of FIGS. 2 and 4 the disc 26 is rotated such that the radius 33 of the disc 26 intersects the cutter head axis A. A recess or cut-out **26*a* of the disc 26 renders it possible to remove from the shaft 11 a cutter head 12 having the ground cutters or cutting tools 13, 14 and 15 and to mount a different cutter head 12 having cutters 13, 14 and 15 which are still to be ground. Two groups of cutters 14, 15 are then either subsequently removed or are removed prior to mounting the cutter head 12 in the grinding machine. The disc 26 now is rotated to such an extent that the cutter head axis A intersects the radius 31 of the disc 26. As particularly clearly evident from the showing of FIGS. 1 and 4, the motors 28 and 29 at the disc 26 must be shifted radially and tangentially such that the grinding discs 19 and 20 contact the cutters or cutting tools 13. Thereafter, the motors 28 and 29 are rigidly secured to the disc 26, i.e. secured against any radial and tangential displacement. Since during grinding the cutters 13 become short, it is necessary to reshift the housing 10 with the shaft 11 and the cutter head 12 upon the support or carrier 24 in the direction of the shaft 11 towards the disc 26. In this way it is possible to grind the outer flanks 16 and the inner flanks 17 of the cutters 13. As will be apparent from FIGS. 1 and 2, there is simultaneously ground an inner flank 17 of one cutter 13 by means of the grinding disc 20 and an outer flank 16 of the other cutter 13 with the grinding disc 19. As soon as both of these flanks 16 and 17 have been ground, then the cutter head 12 is rotated about its axis to such an extent until both of the next cutters 13—not visible in FIG. 2—come into engagement with the grinding discs 19 and 20. In this way, it is possible to grind all of the outer and inner flanks 16 and 17 resepectively, of the entire group of cutters 13 of a cutter head 12. Thereafter, the disc or disc member 26 is rotated to such an extent that the radius 32 intersects the cutter head axis A (FIG. 2). As partiuclarly evident from the shqwing of FIGS. 1 and 4, now the motor 30 together with the grinding disc 21 must be shifted radially and tangentially to such an extent at the disc 26 that the grinding disc 21 contacts the cutting face or surface 18 of cutter 13. Thereafter, the motor 30 is rigidly connected with the disc 26, i.e., it is secured against any radial and tangential displacement. Also, during grinding of the cutting surface or face 18 the housing 10 together with the shaft 11 and the cutter head 12 shifts upon the support or carrier 24 in the direction of the shaft 11 towards the disc 26. As soon as a cutting face 18 has been ground, then, the cutter head 12 is rotated about its axis A to such an extent until the next cutter 13—not visible in the showing of FIG. 2—comes into engagement with the grinding disc 21. In this manner it is possible to grind all of the cutting surfaces or faces 18 of the entire group of cutters 13 of a cutter head 12**.

As soon as the entire group of cutters 13 has been ground, then the second group of cutters 14 is inserted into the cutter head 12 and equally ground in the aforedescribed manner. Finally, the third group of cutters 15 is inserted into the cutter head 12 and ground.

While there are shown and described present preferred embodiments of the invention, it is to be distinctly understood that the invention is not limited thereto, but may be otherwise variously embodied and practised within the scope of the following claims. Accordingly, What I claim is:

1. A grinding machine for grinding cutters detachably secured to a cutter head of a gear cutting machine, each cutter having an inner flank, an outer flank and a cutting face and the cutter head possessing sets of cutters of three respective cutter groups encompassing inner cutters, located along a first circle having a first radius, outer cutters located along a second circle having a second radius and auxiliary cutters located on a third circle having a third radius, comprising:

a shaft fixed on said cutter head, a shaft bearing fixed on said grinding machine supporting said shaft with said cutter head;

a disk member;

a first grinding means for grinding the outer flanks of the cutters;

a second grinding means for grinding the inner flanks of the cutters, each of said first and second grinding means having a grinding disk rotatable about an axis arranged at an angle relative to said disk and the projection of those axes on said disk member are normal to a common radius of said disk member;

a third grinding means for grinding the cutting faces of the cutters, said third grinding means having a grinding disk rotatable about an axis arranged parallel to a radius of said disk member intersecting the axis of the cutter head;

a separate respective drive means for each of the three grinding disks;

said disk member having a recess which renders it possible to remove a cutter head and to mount a different cutter head; and said grinding means with their respective driving means being attached to said disk member and said cutter shafts upon a support in the direction of the shafts towards said disk member in order to selectively bring into engagement at least one of said grinding disks with said cutters located at said cutter head.

* * * * *